US009803545B1

(12) United States Patent
Whitmer

(10) Patent No.: US 9,803,545 B1
(45) Date of Patent: Oct. 31, 2017

(54) ENGINE COOLANT FORWARD FLUSHING APPARATUS AND METHOD

(71) Applicant: David Coleman Whitmer, Oxnard, CA (US)

(72) Inventor: David Coleman Whitmer, Oxnard, CA (US)

( * ) Notice: Subject to any disclaimer, the term of this patent is extended or adjusted under 35 U.S.C. 154(b) by 433 days.

(21) Appl. No.: 14/339,658

(22) Filed: Jul. 24, 2014

Related U.S. Application Data

(60) Provisional application No. 61/858,307, filed on Jul. 25, 2013.

(51) Int. Cl.
*F02B 77/04* (2006.01)
*B08B 9/08* (2006.01)

(52) U.S. Cl.
CPC ..... *F02B 77/04* (2013.01); *B08B 9/0804* (2013.01); *F02B 2077/045* (2013.01)

(58) Field of Classification Search
None
See application file for complete search history.

(56) References Cited

U.S. PATENT DOCUMENTS 2,029,232 A 1/1936 Green
4,083,399 A 4/1978 Babish
4,161,979 A 7/1979 Stearns
4,176,708 A 12/1979 Joffe
4,178,134 A 12/1979 Babish
4,293,031 A 10/1981 Babish
4,390,049 A 6/1983 Albertson
4,553,587 A 11/1985 Traylor
4,619,618 A 10/1986 Patti
4,790,882 A 12/1988 Barres
4,791,890 A 12/1988 Miles
4,793,403 A 12/1988 Vataru
4,840,223 A 6/1989 Lee
4,899,807 A 2/1990 Vataru
4,901,786 A 2/1990 Vataru
4,911,211 A 3/1990 Andersen
5,097,894 A 3/1992 Cassia
5,103,878 A 4/1992 Cassia
5,267,606 A 12/1993 Cassia
5,571,420 A 11/1996 Creeron
5,649,574 A 7/1997 Turcotte
5,804,063 A 9/1998 Creeron
5,809,945 A 9/1998 Creeron
5,845,684 A 12/1998 Fletcher
6,109,987 A 8/2000 Watanabe
6,135,064 A 10/2000 Logan
6,637,472 B2 10/2003 Camacho
7,111,650 B2 9/2006 Few
8,165,781 B2 4/2012 Johnson
2005/0205119 A1 9/2005 Awad

*Primary Examiner* — Jason Ko
(74) *Attorney, Agent, or Firm* — Thomas I. Rozsa

(57) ABSTRACT

An apparatus and method used to maintain an engine coolant system and related components, which may be easily and quickly connected to multiple configurations and sizes, whereby an engine forward flushing can be accomplished.

3 Claims, 7 Drawing Sheets

ENGINE COOLANT FORWARD FLUSHING APPARATUS AND METHOD

This patent application claims priority to Provisional Application No. 61/858,307 filed on Jul. 25, 2013.

BACKGROUND OF THE INVENTION

1. Field of the Invention

The present invention relates to apparatuses and methods for flushing engine coolant systems and associated components. Flushing an engine coolant system is messy, and requires a lot of fluid to adequately remove the old coolant, sediment, scale or rust. A common method of flushing coolant systems that have accumulated excessive amounts of sediment, rust, and scale is the "flush and fill" method. This method requires adding a flushing additive to a coolant system, running an engine for a period of time, waiting for the engine to cool down, draining the coolant system by removing the lower radiator hose and draining the engine into a pan, then drain the radiator into a pan by opening a petcock or removing a drain plug on the radiator, then reattach the lower radiator hose close the petcock or reinstall the drain plug on the radiator, add more fluid and repeat procedure until an adequate flush is achieved. Another method requires the use of a Flush and Fill Kit sold by Prestone. With the Prestone kit method, a user utilizes an unregulated, pressurized water source, which could cause leaks and result in damage from excessive pressure and flow. These methods create unnecessary amounts of hazardous discharged fluids, which must be properly disposed of. With the environmental concerns of the present day, hazardous waste spills and disposal are major considerations. Current systems and methods do not flush coolant systems efficiently, do not minimize the amount of discharge generated, or minimize the spilling of the discharge. Therefore a new method and apparatus is needed in the field.

2. Description of the Prior Art

Subsequent to filing the provisional patent application, the present inventor had a formal patent novelty search performed. The following seven patents are the closest prior art of which the inventor had knowledge prior to filing this full patent application.

1. U.S. Pat. No. 3,409,218 issued to Moyer on Nov. 5, 1968 for "APPARATUS FOR CLEANING AND FILLING AUTOMOTIVE ENGINE COOLING SYSTEMS". This patent only discloses the pictures and does not disclose how the patent works. Therefore, other than satisfying the duty of candor and disclosure or knowing about the patent, the Applicant is not able to provide any further input as to what this patent shows.

2. U.S. Pat. No. 5,103,878 issued to Cassia on Apr. 14, 1992 for "APPARATUS AND METHOD FOR FLUSHING AND DRAINING THE COOLANT SYSTEM OF A VEHICLE". This patent discloses a system that has a radiation cap. Few to no coolant systems that have an expansion tank have a radiator with a radiator cap. In the flushing process contaminated fluid is reintroduced back into the radiator. The present invention is different from the invention disclosed in this patent in that the present invention requires one continuous cycle and the contaminated fluid does not go back into the system. To drain the system, pressurized water (a water hose) is used to displace fluid in the radiator. With respect to the disclosure in this prior art patent, it does not appear that a user can introduce a second fluid, such as anti-freeze without draining the radiator from the lower petcock or using an external pump. The present invention system adds anti-freeze at the end of the cycle. This prior art patent discloses a clear tube to see what condition the fluid is in, The present invention clear diagnostic tube is used for a completely different purpose. With the present invention a user could check the condition of the fluid by looking at the discharge coming out of the discharge hose. Also, in this prior art invention, fluid is removed from the radiator, not the upper radiator hose. The present invention is simpler and has fewer elements to remove the fluid from a different method. Therefore, the present invention is totally different from this prior art reference.

3. U.S. Pat. No. 5,845,684 issued to Fletcher on Dec. 8, 1998 for "FLUSH AND FILL APPARATUS FOR COOLANT SYSTEMS AND METHOD OF USE." This patent discloses a clean and easy-to-use, portable upright apparatus, and a method for its use, which can be used to flush and fill the radiator and coolant systems of motorized vehicles in approximately fifteen minutes. The apparatus comprising a self-priming pump, a waste collection tank, a tank for holding new or recycled coolant, a filter assembly, and a wheeled support structure for conveniently and efficiently housing the pump, tanks, filter assembly, and the several hoses needed to perform the flush and fill procedure. Applications may include, but are not limited to, flushing coolant from automobile radiators and refilling them with new or recycled coolant. It was determined that this prior art does not disclose the present invention.

4. U.S. Pat. No. 4,911,211 issued to Andersen on Mar. 27, 1990 for "APPARATUS AND METHOD FOR CHANGING COOLANT IN VEHICLE COOLING SYSTEM." This patent discloses an apparatus and method for changing the antifreeze in a vehicle which requires only a garden hose and opening of the radiator cap. Water from the hose is utilized to prime a conduit for siphoning used coolant from a side of the radiator and for refilling the radiator. By operating the vehicle with fresh water in the radiator, coolant remaining in the system is mixed with the water, and repeated drainings decrease the remaining used antifreeze by about one-half each time. After removal of the desired amount of antifreeze, new antifreeze may be placed in the radiator. This patent discloses a system that has a radiation cap. Few to no coolant systems that have an expansion tank have a radiator with a radiator cap. This system requires three different cycles to accomplish a fluid exchange and multiple valve switching. In each cycle contaminated fluid is reintroduced back into the radiator. The present invention requires one continuous cycle and the contaminated fluid does not go back into the system. To drain the system a siphoning action must take place. The present invention uses the pressure from the water pump and fluid replenishment through the radiator pipe. There is no method to tell when the system is filled except when fluid overflows out of the radiator neck. The prior art mentions a clear tube to see what condition the fluid is in. The present invention sight tube is used for a completely different purpose. With the present invention a user could check the condition of the fluid by looking at the discharge coming out of the discharge hose. Fluid is removed from the radiator, not the upper radiator hose. The present invention is simpler and has fewer elements than the cited reference. Also, the cited reference is utilizable only with a cross flow or a side tank type of radiator where the radiator tanks are vertically positioned on either side of the radiator core. Almost ninety percent of domestic vehicles use the cross flow radiator, although only twenty percent of imported cars are so equipped.

5. U.S. Pat. No. 5,103,978 issued to Cassia for "APPARATUS AND METHOD FOR FLUSHING AND DRAINING THE COOLANT SYSTEM OF A VEHICLE". This patent discloses a system that has a radiation cap. Few to no coolant systems that have an expansion tank have a radiator with a radiator cap. In the flushing process contaminated fluid is reintroduced back into the radiator. The present invention requires one continuous cycle and the contaminated fluid does not go back into the system. To drain the system pressurized water (a water hose) is used to displace fluid in the radiator. The present inventor does not see how a user can introduce a second fluid, such as anti-freeze without draining the radiator from the lower petcock or using an external pump. This patent mentions a clear tube to see what condition the fluid is in. The present invention sight tube is used for a discharge coming out of the discharge hose. Fluid is removed from the radiator and not the upper radiator hose. The present invention is simpler than this prior art disclosure and has fewer elements.

6. U.S. Pat. No. 5,804,063 issued to Creeon et al. for "COOLING SYSTEM CHANGE-OVER APPARATUS AND PROCESS". In this patent disclosure, at the attachment point there is no consideration for the multi-sized radiator hoses on different vehicles. When the thermostat closes, a user must stop adding fluid into the system once it is filled or an overflow will occur. There is no method to indicate how full the coolant system is. On the other side of it, if the fluid is not adequately replenished, an overheating could occur. Additionally, if air is allowed to get into the coolant system by not adding enough replenishing fluid, the water pump could cavitate or the thermostat might not operate properly. If air gets trapped next to a thermostat, the thermostat might not open (a thermostat is designed to sense heat from fluid). When this happens, the fluid in the engine boils causing what is called "tea kettling" which is steam and short bursts of fluid spitting out of the discharge hose. An expansion tank is not considered or referenced.

7. U.S. Pat. No. 5,809,945 issued to Berke et al. for "DRAIN-AND-FILL METHODS AND APPARATUS FOR AUTOMOTIVE COOLING SYSTEMS". In this patent the process shows a drain and fill machine with a first reservoir for storing fresh or recycled antifreeze/coolant. At the attachment point there is no consideration of the multi-sized radiator hoses on different vehicles. The reservoir is positioned higher than the radiator for gravity forced displacement (like the fluid invention fluid supply assembly FIG. 1). In the prior art setup an expansion tank is not mentioned or considered. If the first reservoir (supply) was located higher than a vented expansion tank, fluid would be continually overflowing out of the expansion tank by gravitational force displacement. If an expansion tank is not vented, fluid can get trapped and it takes more fluid to properly flush the system, creating more waste than necessary. On some coolant system setups the radiator pipe is higher than the expansion tank and sometimes the expansion tank is higher than the radiator. With this machine the reservoir is stated to hold fresh or recycled antifreeze/coolant. If a user wanted to add a different fluid, the reservoir would have to be manually emptied before a different fluid could be used or use up all of the fluid in the reservoir, which could create unnecessary waste. When flushing out a coolant system, there is no set amount of fluid to be used, it depends on the condition of the system. The present invention allows a user to use just enough fluid to flush the system properly, then add a proper amount of a second fluid like antifreeze. The present invention is more portable, smaller, and has fewer elements.

SUMMARY OF THE INVENTION

The primary objective of the present invention is to provide the ability to efficiently forward flush a liquid cooled engine, and related coolant system components such as a radiator, heater core, expansion tank, radiator hoses, and heater hoses with a selected fluid.

Another object of the present invention is to provide the ability to forward flush a coolant system by allowing a thermostat to open and discharge fluid while adding more fluid.

Another object of the present invention is to provide the ability to flush a coolant system by utilizing an engine water pump to circulate and discharge fluid out of a coolant system.

Another object of the present invention is to provide the ability to forward flush a coolant system through a radiator pipe.

Another object of the present invention is to provide the ability to forward flush a coolant system through an expansion tank.

Another object of the present invention is to provide the ability to flush a coolant system from an upper radiator hose.

Another object of the present invention is to provide the ability to flush a coolant system from an upper radiator hose connection.

Another object of the present invention is to provide the ability to direct a discharge fluid from an upper radiator hose.

Another object of the present invention is to provide the ability to direct a discharge fluid from an upper radiator hose connection.

Another object of the present invention is to provide the ability to supply an adequate amount of flushing fluid so an engine does not over heat.

Another object of the present invention is to provide the ability to supply an adequate amount of flushing fluid so that an engine water pump does not cavitate.

Another object of the present invention is to provide the ability to supply an adequate amount of flushing fluid so that the engine does not boil internally.

Another object of the present invention is to provide the ability to effectively vent a radiator during the forward flushing process.

Another object of the present invention is to provide the ability to effectively vent an expansion tank during the forward flushing process.

Another object of the present invention is to provide the ability to visually verify a coolant system with a radiator neck when the radiator neck is adequately filled.

Another object of the present invention is to provide the ability to visually verify a coolant system with an expansion tank when the expansion tank is adequately filled.

Another object of the present invention is to provide the ability to add fluid without overflowing through a radiator neck.

Another object of the present invention is to provide the ability to add fluid without overflowing through an expansion tank orifice.

Another object of the present invention is to provide the ability to determine that a thermostat is functioning properly.

Another object of the present invention is to provide the ability to determine that an engine water pump is functioning properly.

Another object of the present invention is to provide the ability to efficiently flush a sealed radiator system.

Another object of the present invention is to provide the ability to efficiently flush an expansion tank.

Another objective of the present invention is to provide the ability to minimize the hazardous discharge generated.

Another objective of the present invention is to provide the ability to capture the maximum amount of hazardous discharge during the process.

Another objective of the present invention is to provide the ability to flush a coolant system in an environmentally safe method.

Another object of the present invention is to provide the ability to transfer a selected fluid into a coolant system.

Another object of the present invention is to provide the ability to displace a first fluid with a second different fluid.

Another object of the present invention is to provide the ability to replace a first fluid that is presently in a coolant system with a second different fluid.

Another object of the present invention is to provide the ability control the ratio of mixed selected fluids.

Another object of the present invention is to provide the ability to flush a complete coolant system.

Another object of the present invention is to provide an array of assemblies and adaptors to facilitate the different sized hoses and pipes related to a coolant system.

Another object of the present invention is to provide an adaptor or an assembly that can be fitted into multiple sized radiator hoses.

Another object of the present invention is to provide an adaptor or an assembly that can be fitted onto multiple sized radiator pipes.

Another object of the present invention is to provide the ability to configure and interchange assemblies, adaptors, fittings and hoses.

Another object of the present invention is to provide the ability of assemblies, adaptors, hoses, and fittings to be secured well enough that during the flushing procedure so as to not cause slippage or leaks from a coolant system hoses and pipes.

Another object of the present invention is to provide the ability to visually observe the condition of a selected fluid.

This invention also has for its objects to provide such means that are positive in operation, convenient in use, easily installed in a working position and easily disconnected therefore, economical to manufacture, relatively simple, and of general superiority and serviceability.

Described in detail, the present invention is an apparatus to forward flush dirty coolant from a liquid cooled engine including a discharge hose assembly including a length of flexible hose, a hose clamp adjacent one end with a barbed connector retained at the first end, the apparatus to forward flush coolant comprising: (a) a fluid supply assembly including a tube connected at one end to a 90 degree fitting, which 90 degree fitting is retained at a first end to the tube by a hose clamp, the 90 degree fitting receiving a quick release connected at a second end of the 90 degree fitting; (b) a pipe adapter assembly including a threaded, quick release connector threaded into a threaded adapter located within an adjacent one end of a radiator hose, a clamp affixed on an exterior surface; (c) a hose adapter assembly including a threaded quick release connector threaded into one end of a rigid cylindrical shaped adaptor which has a multiplicity of spaced apart grooves on its cylindrical surface; (d) a sight tube assembly including a transparent tube with a first frustum shaped cone surrounding the transparent tube for a given distance adjacent a first end of the transparent tube and a second frustum shaped cone surrounding the transparent tube for a given distance adjacent a second end of the frustum shaped tube; (e) a discharge/diagnostic hose assembly including a length of flexible hose, a barbed connector received in a first end of the length of a flexible hose and retained by a first hose clamp, and a clear diagnostic tube retained adjacent a second end of the length of a flexible hose by a threaded hose barb and a threaded cylindrical insert with the length of flexible hose and retained by a second hose clamp; (f) a funnel inserted into the fluid supply assembly, the quick release connector of the fluid supply assembly connected to the threaded quick release connector of the hose adaptor assembly and connected at its opposite end to an upper radiator hose which in turn is connected to a radiator by a radiator pipe, the radiator connected by fluid tubes to an expansion tank with the sight tube assembly retained in the expansion tank with the transparent tube and one frustum shaped cone visible; (g) a radiator hose connecting the expansion tank to an engine; and (h) the engine connected to a thermostat which in turn is connected to a radiator hose connection connected to the pipe adaptor assembly with its threaded quick release connector to the barbed connector of the discharged hose assembly with its length of flexible hose extending from the barbed connector to a waste receptacle; (i) when the discharge hose assembly is opened and the engine is turned on, the fluid temperature in the engine is heated until the fluid temperature causes the thermostat to open at a designated temperature so that the engine water pump circulates the dirty heated fluid through the engine coolant system and pulls dirty fluid into the lower radiator hose from the radiator and the expansion tank and out of the discharge hose into a waste receptacle after the dirty coolant has been removed and replenishes the dirty fluid coolant with fresh coolant which is poured into the funnel so clean coolant is replenished directly into the radiator pipe until the coolant system is filled with clean coolant fluid.

Described more broadly, the present invention is a an apparatus to forward flush dirty coolant from a liquid cooled engine, comprising (a) a fluid supply assembly including a tube connected at one end to a 90 degree fitting, which 90 degrees fitting is retained at a first end to the tube by a hose clamp, the 90 degree fitting receiving a connector at a second end of the 90 degree fitting; (b) a hose adjuster assembly including a connector retained in an adapter located within an adjacent one end of a radiator hose; (c) a hose adapter assembly including a connector retained into one end of a cylindrical shaped adapter; (d) a discharge/diagnostic hose assembly including a length of flexible hose, a connector in a first end of the length of a flexible hose and retained in the diagnostic discharge hose, a clear diagnostic tube retained adjacent a second length of a flexible hose by a hose barb and a cylindrical insert with the second length of hose retained by a retaining member; (e) a water/coolant insertion member inserted into a fluid supply assembly, the connector of the fluid supply assembly connected to a connector of the hose adaptor and connected at its opposite end to an upper radiator hose which in turn is connected to a radiator by a radiator pipe, the radiator connected by fluid tubes to an expansion tank, a member to create a transparent member selected from the group consisting of the expansion made of transparent material and a sight tube assembly inserted into the expansion tank, the tube assembly including a transparent tube visible from the expansion tank; (f) a radiator hose connecting the expansion to an engine containing fluid and a water pump; and (g) the engine connected to a thermostat which in turn is connected to a radiator hose connection connected to the hose adaptor assembly with its connector connected to a connector of a discharge hose assembly with a length of flexible hose extending from the discharge hose connector to a waste receptacle; (h) when the discharge/diagnostic hose assembly is opened and the engine is turned on, a fluid temperature in the engines is heated until the fluid temperature causes the thermostat to open at a designated temperature so that the engine water pump circulates the dirty heated fluid through the engine coolant system and pulls dirty fluid into the lower radiator hose from the radiator and the expansion tank including the dirty coolant inside the engine and out of the discharge hose into a waste receptacle after the dirty coolant has been removed and replenishes the dirty fluid coolant with fresh coolant selected from the group consisting of fresh coolant, water and anti-freeze, which is poured into the water/coolant insertion member so clean coolant is replenished directly into the radiator pipe until the coolant system is filled with clean coolant fluid and then the discharge hose is closed.

Described alternatively, the present invention is a method of forward flushing a fluid cooled engine having an engine coolant system, dirty fluid in the engine, a thermostat, an engine water pump, a heater core with hoses, an upper radiator hose in fluid communication with a discharge hose, a lower radiator hose in fluid communication with a radiator, a radiator pipe connected to the radiator, and with an expansion tank, an exterior waste receptacle comprising: (a) turning the engine on and heating the dirty fluid in the engine until the fluid temperature causes the thermostat to open at a designated temperature; (b) enabling the engine water pump to circulate the dirty heated fluid throughout the engine coolant system including through the heater core with hoses and out of the upper radiator hose while pulling dirty fluid into the lower radiator hose from the radiator and the expansion tank; (c) enabling the dirty heated fluid to be circulated out of the discharge hose and into a waste receptacle; and (d) after the dirty heated fluid is removed from the engine, the coolant is selected from the group consisting of fresh coolant, water and anti-freeze and causes the fresh coolant to be poured directly into a radiator pipe, so that when the coolant system is filled to capacity, fluid will rise in a transparent member of the expansion tank verifying that the cooling system is filled and then the discharge hose is closed.

Also described, the present invention is a method of flush a fluid cooled engine further comprising a clear visible tube is raised above the radiator pipe during the flushing process.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF EMBODIMENTS OF THE PRESENT INVENTION

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
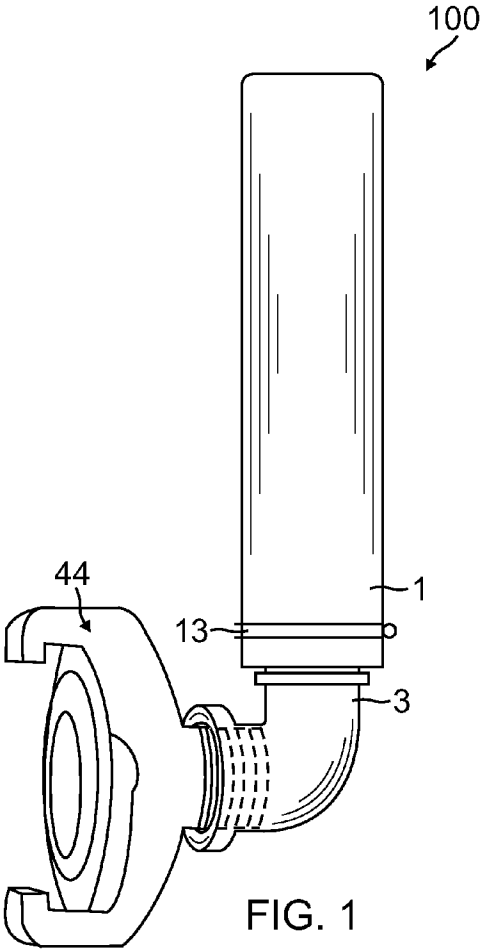
FIG. 1 illustrates a side view showing an example of a fluid supply assembly.

FIG. 1 illustrates an example of a fluid supply assembly 100 comprising, generally, a tube 1, a hose clamp 13, a 90 degree fitting 3 and a threaded connector 44. A fluid supply assembly 100 could be used to directly supply a selected fluid into a radiator 58. In a different embodiment a tube 1 could be semi-rigid. In a different embodiment a tube 1 could be rigid. In a different embodiment a 90-degree fitting 3 could be a different connector including a quick release connector. A 90 degree fitting 3 is preferably, but not necessarily of the traditional size and thread configuration used in the field. In a different embodiment a top section of the tube 1 could have a trapezoidal shape so as to accommodate a funnel. The 90 degree fitting 3 is connected to a threaded connector which is be a quick release connector as illustrated.

Figure 2:
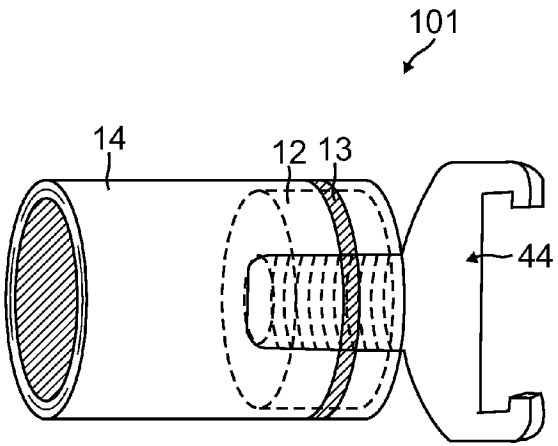
FIG. 2 illustrates a side view showing an example of a pipe adaptor assembly.

FIG. 2 illustrates a pipe adaptor assembly 101 comprising, generally, a threaded connector 44, a threaded adaptor 12, a length of radiator hose 14 and a properly sized hose clamp 13. After removing a radiator hose from a radiator pipe 43 (see FIGS. 7, 8 and 9), a pipe adaptor assembly 101 can be slipped over a radiator pipe 43 or a radiator hose connection 36 (See FIGS. 7, 8 and 9) and secured by means of an adjustable hose clamp 7 so as to minimize slippage and leaks while under pressure. A pipe adaptor assembly 101 provides the ability to direct fluid to and from a coolant system. In a different embodiment a pipe adaptor assembly 101 could have an array of multiple inside diameters to facilitate the different sized pipes related to various coolant systems. Most coolant systems are engineered to utilize a standard sized radiator hose 35, typically between sizes 1⅛ to 2¼ inch inside diameter but other sizes are contemplated herein. The inside diameter of the multiple pipe adaptor assembly 101 is preferably, but not necessarily, between about 1⅛ and 2¼ inch but other sizes are contemplated herein. The outside diameter of a radiator pipe 43 coincides with the inside diameter of a radiator hose 35. It is possible to supply a pipe adaptor assembly 101 with a close fit for each size of radiator pipe 43. In a different embodiment, a pipe adaptor assembly 101 may be sized to fit over two or more different sized radiator pipes 43, thus eliminating the need for a close or tightly fitting pipe adaptor assembly 101, which could minimize the cost of production. The length of a radiator hose 14 is preferably, but not necessarily between about 1½ and 6 inches in length but it is more preferably about 3½ inches in length. A threaded connector 44 is preferably, but not necessarily of the traditional size and thread configuration used in the field. In a different embodiment a threaded connector 44 could be different connector including a quick release connector.

Figure 3:
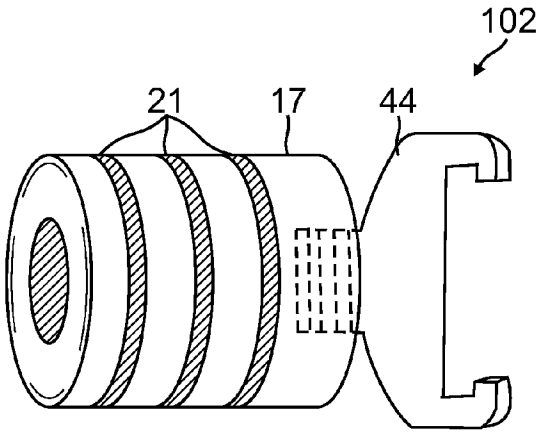
FIG. 3 illustrates a side view showing an example of a hose adaptor assembly.

FIG. 3 illustrates a hose adaptor assembly 102 comprising, generally, a threaded connector 44 a rigid cylindrical shaped adaptor 17 and grooves 21. After removing a radiator hose 35 from a radiator pipe 43, a hose adaptor assembly 102 could be inserted into a radiator hose 35 and secured by means of an adjustable hose clamp 7 so as to minimize slippage and leaks from a radiator hose 35 while under pressure. A hose adaptor assembly 102 provides the ability to direct fluid to and from the coolant system. In a different embodiment a hose adaptor assembly 102 could have an array of multiple sizes with outside diameters to facilitate the different sized hoses related to various coolant systems. Most coolant systems are engineered to utilize a standard sized radiator hose 35, typically between sizes 1⅛ to 2¼ inches but other sizes are contemplated herein. The outside diameter of the multiple hose adaptor assembly 102 is preferably, but not necessarily, only between about 1⅛ and 2¼ inch but other sizes are contemplated herein. The inside diameter of a radiator hose 35 coincides with the outside diameter of a radiator pipe 43. It is possible to supply a hose adaptor assembly 102 with a close fit for each size of radiator hose 35. In a different embodiment, the adaptor may be sized to fit into two or more different sized radiator hoses 35, thus eliminating the need for a close fitting hose adaptor assembly 102, which could minimize the cost of production. In a different embodiment a hose adaptor assembly 102 has preferably, but not necessarily between about 1¼ and 1⅜ inch outside diameter; but preferably it has about 1 5/16 inch outside diameter. In a different embodiment a hose adaptor assembly 102 has preferably, but not necessarily between about 1½ and 1⅝ inch outside diameter; but it has more preferably about 1 37/64 inch outside diameter. In a different embodiment a hose adaptor assembly 102 has preferably, but not necessarily between about 1¾ and 1⅞ inch outside diameter, but more preferably it has about 1 25/32 inch outside diameter. Therefore, in some embodiments, a hose adaptor assembly 102 may fit loosely into a first hose at one end and fit more tightly or securely into a second hose at a second end. The length of the rigid cylindrical shaped hose adaptor assembly 102 is preferably but not necessarily between about ½ and 2½ inches in length but it is more preferably about 1¼ inch in length. A threaded connector 44 is preferably, but not necessarily of the traditional size and thread configuration used in the field. In a different embodiment a hose adaptor assembly 102 could have grooves 21 to provide additional means for securing a hose adaptor assembly 102 to a radiator hose 35 so as to minimize slippage and leaks from the hose while under pressure. The number of grooves 21 is preferably, but not necessarily between about 1 and 5 but it is more preferably about 3. In a different embodiment a hose adaptor assembly 102 preferably but not necessarily includes grooves 21. In a different embodiment a hose adaptor assembly 102 could have a beveled end to facilitate ease of insertion into a selected hose. In a different embodiment a hose adaptor assembly 102 could be but not necessarily a catenoid shape. In a different embodiment a threaded connector 44 could be different connector including a quick release connector.

Figure 4:
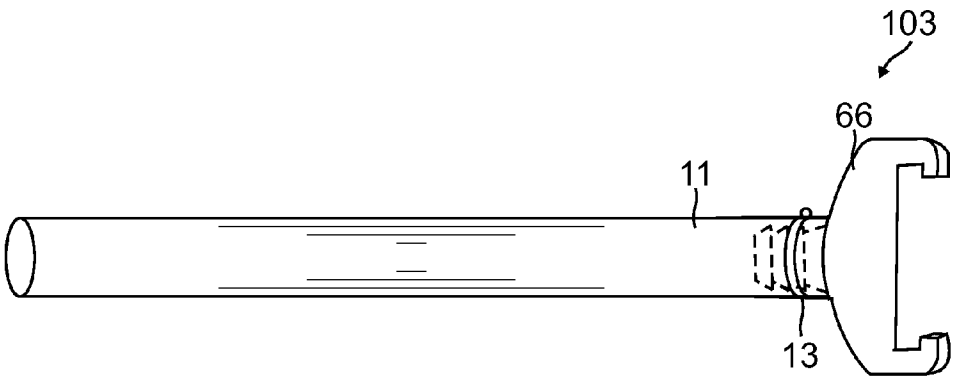
FIG. 4 illustrates a side view showing an example of a discharge hose assembly.

FIG. 4 illustrates a discharge hose assembly 103 comprising, generally, a length of flexible hose 11, a hose clamp 13 and a barbed connector 66. A barbed connector 66 could enable a user to remove and interchange different adaptors. A flexible hose 11 preferably, but not necessarily, has between about ½ and 1 inch inside diameter but more preferably the inside diameter is about ¾ inch. In a different embodiment a flexible hose 11 could be heat resistant. In a different embodiment a transparent flexible hose 11 could allow a user to visually observe the condition of a fluid. A flexible hose 11 is preferably, but not necessarily transparent. The method of disengaging a radiator hose 35 from a radiator pipe 43 and letting the hazardous discharge drain into a pan under the vehicle is common. With this method, hot fluid could spill onto various engine components such as belts, hoses, water pumps, fans, and onto the floor or ground. By attaching a discharge hose assembly 103 to a radiator hose 35, radiator pipe 43, or a radiator hose connection 36, the hot hazardous discharged fluid could be directed into a receptacle 38 (See FIG. 7), thus capturing the maximum amount of a discharged hot hazardous fluid, with minimal spillage. In a different embodiment a flexible hose 11 could be reinforced. In a different embodiment a flexible hose 11 could be chemical resistant. In a different embodiment a discharge hose 103 could have a weighted rigid tube inserted into the discharge end. A flexible hose 11 could have a tendency to curl up, by adding a weighted rigid tube to the discharge end and this could enhance the ability to keep the flexible hose 11 in the proper position, minimizing the possibility of spilling discharged fluids. In a different embodiment a barbed connector 66 could be a different connector including a quick release connector.

Figure 5:
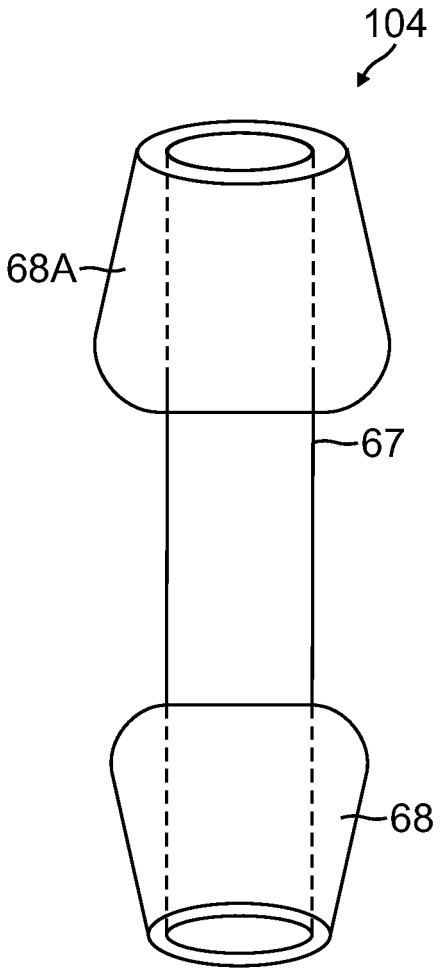
FIG. 5 illustrates a side view of a sight tube.

FIG. 5 illustrates a sight tube assembly 104 comprising, generally, a length of transparent tube 67 with pliable frustum shaped cones 68 and 68A. A sight tube assembly 104 could be inserted into orifices with various diameters such as a radiator neck 59 or an expansion tank 47. Fluid is added to a coolant system through a radiator pipe 43 by means of a pipe adaptor assembly 101, a fluid supply assembly 100 and a funnel 66. Eventually the coolant system is filled to capacity resulting in an overflow due to displacement through the open radiator neck 59 (See FIG. 7) of open expansion tank 47. With a sight tube assembly 104 a user can verify that the coolant system is filled without causing the radiator 58 or expansion tank 47 (See FIG. 8) to overflow. Additionally, when a fluid in the sight tube assembly 104 is cycled into the coolant system and can no longer be seen, this is an indication of the need to replenish the coolant system with more fluid. In a different embodiment a sight tube assembly 104 might not be needed while flushing a coolant system with a transparent expansion tank 47 as a user could add fluid and observe fluid rising and falling in the transparent expansion tank 47 which could allow a user to add fluid as needed and cease adding fluid before the expansion tank overflows. A sight tube assembly 104 could provide the coolant system with a venting effect, which could help with fluid flow. If a radiator 58 or an expansion tank 47 cap were installed during the forward flushing process a vacuum lock could occur which could encumber the steady flow of fluid. While performing a forward flush on a coolant system it is very important to have an adequate supply of fluid throughout the whole coolant system. An air pocket could be created if an inadequate amount of fluid is being made available to the coolant system. The results could be an engine water pump cavitating. A second result of an inadequate fluid flow could cause a fluid to boil inside an engine 42 (See FIG. 7) creating steam. A thermostat 37 might not open properly if air is trapped next to it, which could interrupt the steady flow of fluid throughout the coolant system. This phenomenon is sometimes called "tea kettling". If "tea kettling" occurs, hot air, steam and intermittent bursts of fluid will exit the discharge hose assembly 103 instead of a steady flow of discharge fluid. By maintaining an adequate supply of fluid in a funnel 66, the fluid supply assembly 100 and an expansion tank 47, the chances of a water pump cavitating, engine fluid boiling, and air trapped next to the thermostat 37 could be minimized. Pliable frustum shaped cones 68 and 68A could have an array of multiple diameters to facilitate the different sized orifices related to various coolant systems. In a different embodiment the transparent tube 67 could be pliable. In a different embodiment the transparent tube 67 could be rigid.

Figure 6:
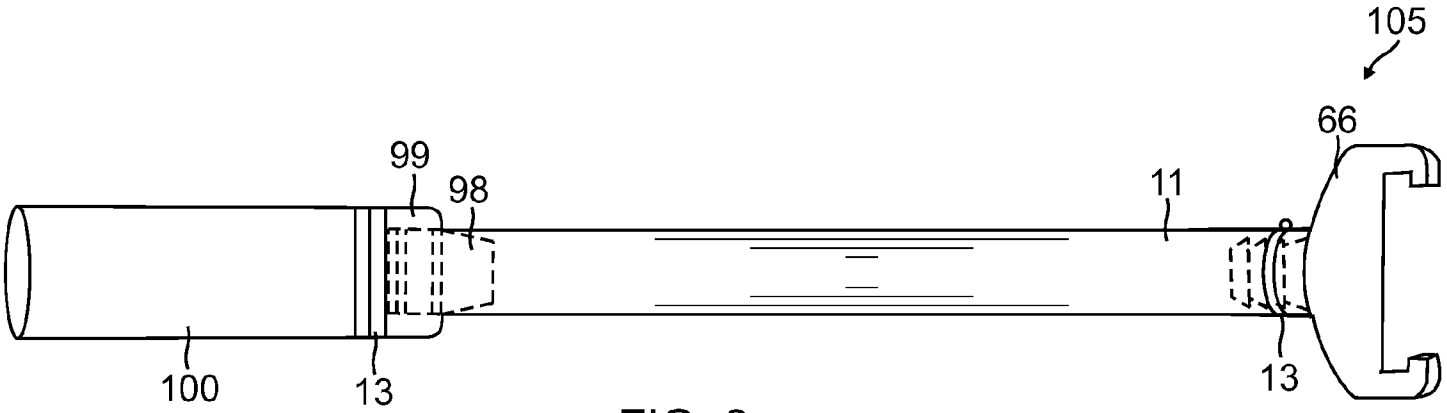
FIG. 6 illustrates a side view showing an example of a discharge/diagnostic hose.

FIG. 6 illustrates a discharge/diagnostic hose assembly 105 comprising generally, a barbed connector 66, a hose clamp 13. a length of flexible hose 11, a threaded hose barb 98, a threaded cylindrical insert 99, a clamp 13 and a clear diagnostic tube 100. A barbed connector 66 enables a user to remove and interchange it with a different adaptor. A flexible hose 11 has preferably between about a ½ to 1 inch inside diameter.

A clear visual tube 100 has preferably, but not necessarily, between about ½ inch and 3 inches inside diameter but more preferably about 2 inches inside diameter. In a different embodiment a clear visual tube 100 could be attached to the flexible hose 11 by way of a cylindrical insert 99 with a threaded connector 44. In this embodiment the visual tube 100 could be raised above the radiator pipe 43 during the flushing process to diagnose a water pump's strength and the circulation flow in the coolant system. With a properly functioning water pump the fluid in the coolant system should rise above the radiator pipe 43. With a malfunctioning water pump, the pressure created by the water pump could be inadequate and therefore, the rise in the visual tube 100 would be less than desired. Additionally, a steady rise in the visual tube 100 would indicate that the coolant system has proper circulation.

Figure 7:
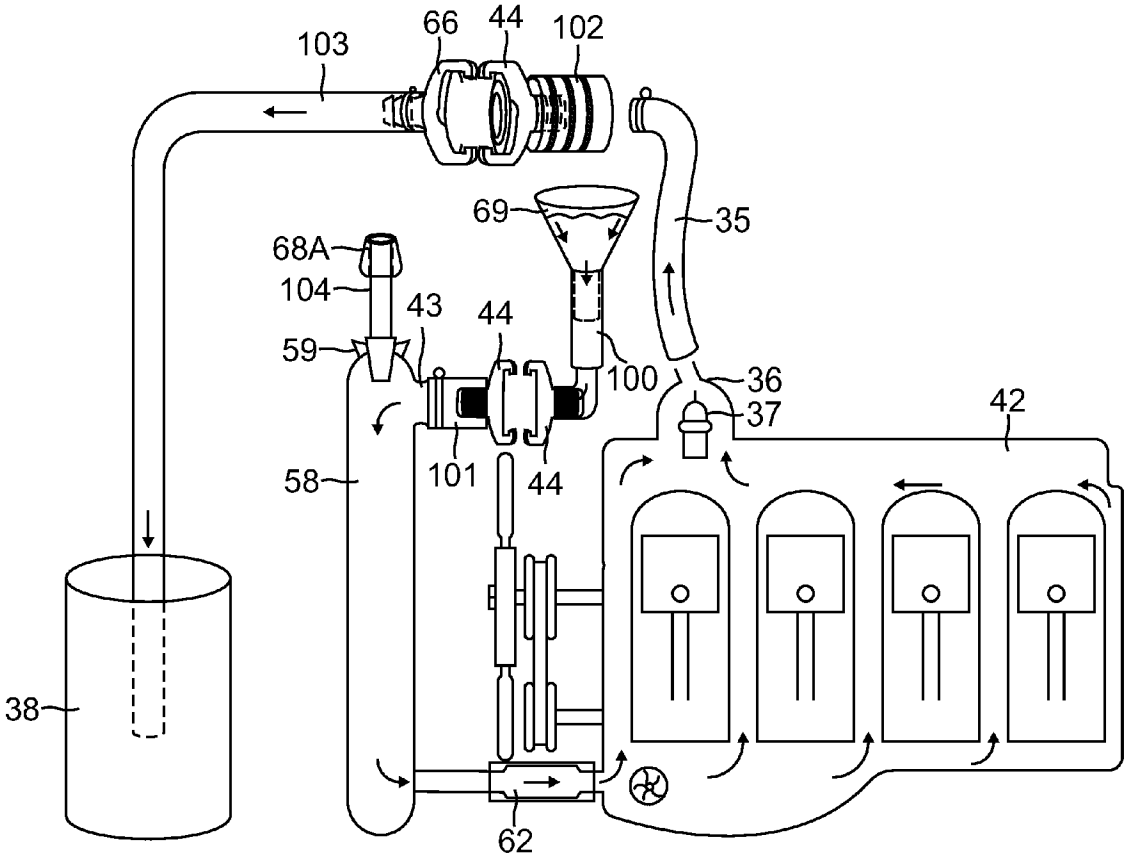
FIG. 7 illustrates an example of a forward flush method and system with a fluid supply assembly connected to a radiator pipe using a coolant system without an expansion tank.

FIG. 7 illustrates a funnel 69, a fluid supply assembly 100, a pipe adaptor assembly 101, a radiator pipe 43, a radiator neck 59 a sight tube assembly 104, a radiator 58, a lower radiator hose 62, an engine 42, a thermostat 37, a radiator hose connection 36, an upper radiator hose 35, a hose adaptor assembly 102, a discharge/diagnostic hose assembly 105) and a waste receptacle 38. Directional arrows indicate the path of fluid flow. This is an example of a forward flush method with a coolant system that has a radiator 58 with a radiator neck 59. A preferred forward flush method is accomplished by heating the dirty fluid in an engine 42 until the fluid temperature causes the thermostat 37 to open at a designated temperature. A water pump circulates the dirty heated fluid through the engine 42 coolant system including a heater core with hoses and out of an upper radiator hose 35 while pulling in dirty fluid into the lower radiator hose 62 from the radiator 58, as the dirty heated fluid is circulated out of the upper radiator hose 35 into a discharge/diagnostic hose assembly 105 and into a waste receptacle 38.

A cooler selected fluid is replenished into the radiator pipe 43 by using a funnel 69 inserted into a fluid supply assembly 100. When the coolant system is filled to capacity, fluid could rise into the sight hose assembly 104 verifying that the coolant system is adequately filled. Circulation periodically ceases when a thermostat 37 closes due to the fluid temperature falling below the thermostat temperature rating. When the fluid temperature in an engine coolant system rises to the temperature rating of the thermostat 37, circulation continues, and a user could verify that circulation is continuing by seeing the fluid level drop in the funnel 69 and sight tube assembly 104. Additionally, the fluid level will rise in a waste receptacle 38 and forward flushing can be continued until the flushing fluid comes out in a preferred condition. Most manufacturers suggest a 50/50 ratio of filtered water and antifreeze. After the flushing fluid comes out to the desired condition, it might be desirable to displace some of the fresh fluid with a selected fluid such as antifreeze. This can be accomplished by calculating the total coolant capacity of the coolant system and after dividing the capacity in half, pouring in that calculated amount of undiluted antifreeze while continuing the forward flushing process. A common forward flush method is accomplished by disconnecting an upper radiator hose 35 from a radiator pipe 43, plugging the radiator pipe 43 with a rag or duct tape and warming up an engine 42. Then when the thermostat 37 opens, the discharge flows from the end of the upper radiator hose 35, pouring down through the engine compartment and into a catch tray, while replenishing fluid through the radiator neck 59. This method is not efficient for multiple reasons. In addition to not adequately controlling the discharge flow which is a hazardous material, the temperature of the fluid that is exiting an upper radiator hose 35 could be 195 degrees Fahrenheit or above and the possibility of fluid spilling onto engine components such as fans, belts, alternators, and other engine components and the possibility of spilling discharged waste onto a repair shop floor or ground is increased. Additionally by replenishing the fluid through a radiator neck 59, the fluid flow could be encumbered, leading to an inadequate amount of fluid being made available to the water pump. The results could be cavitation of the engine water pump. A second result of an inadequate fluid flow could cause the fluid to boil inside the engine 42, creating steam and a thermostat 37 might not open properly if air is trapped next to it, which could interrupt the steady flow of fluid throughout the coolant system. This phenomenon is sometimes called "tea kettling". Replenishing a radiator 58 through a radiator pipe 43 the fluid could be less encumbered resulting in a steady fluid flow. By maintaining an adequate supply of fluid in the funnel 69 and the fluid supply assembly 100, the chances of a water pump cavitation, engine fluid boiling, and air trapped next to the thermostat could be minimized. By utilizing this flushing method it is possible to observe the strength of an engine water pump and ascertain whether it is functioning properly. Additionally, by utilizing this flushing method, it is possible to observe if the thermostat is functioning properly.

Figure 8:
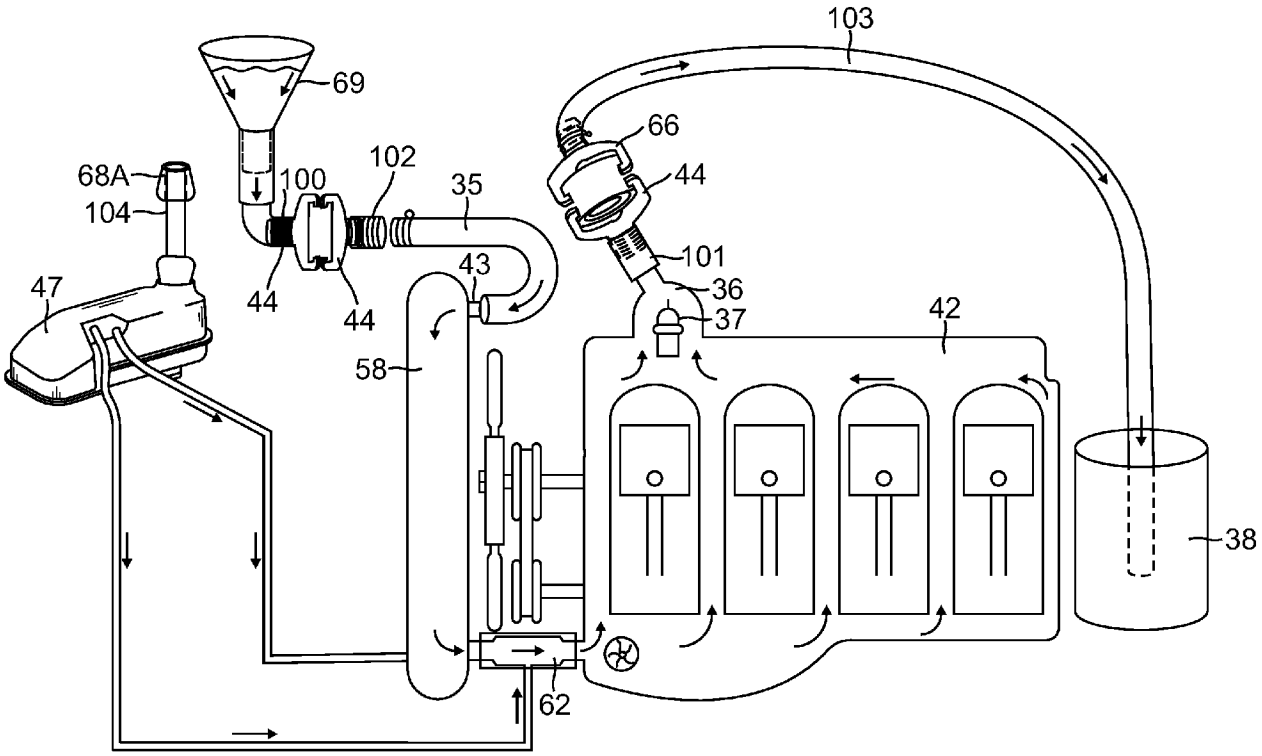
FIG. 8 illustrates an example of a forward flush method and system with a fluid supply assembly connected to a radiator hose using a coolant system with an expansion tank.

FIG. 8 illustrates a funnel 69, a fluid supply assembly 100 connected to a hose adaptor assembly 102, an upper radiator hose 35, a radiator pipe 43, a radiator 58, an expansion tank 47, a lower radiator hose 62, an engine 42, a thermostat 37, a radiator hose connection 36, a pipe adaptor assembly 101, a discharge hose assembly 103 and a waste receptacle 38. Directional arrows indicate the path of fluid flow. This is an example of a forward flush method with a coolant system that has a radiator 58 and an expansion tank 47. A preferred forward flush method is accomplished by heating the fluid in an engine 42 until the fluid temperature causes the thermostat 37 to open at a designated temperature. An engine water pump circulates the dirty heated fluid through the engine coolant system including a heater core with hoses and out of a discharge hose 103 while pulling in fluid into the lower radiator hose 62 from the radiator 58 and expansion tank 47, as the dirty heated fluid is circulated out of the discharge hose 103 and into a waste receptacle 38. A cooler selected fluid is replenished directly into an expansion tank 47 and a radiator pipe 43 by using a funnel 69 inserted into a fluid supply assembly 100. When the coolant system is filled to capacity, fluid will rise into a transparent expansion tank 47 verifying that the coolant system is filled. In a different embodiment than shown in FIG. 7, a user could verify if the coolant system is filled to capacity by employing a sight tube 104 for observing the rise of fluid if an expansion tank is not transparent. In a different embodiment an expansion tank 47 could be positioned well above a hose adaptor assembly 102 and funnel 69 where as fluid is added to a radiator pipe 43, it will not displace fluid into the expansion tank 47. In this case replenishing fluid into an expansion tank 47 could displace fluid into a hose adaptor assembly 102, fluid supply assembly 100 and funnel 69. Circulation periodically ceases when a thermostat 37 closes due to the fluid temperature falling below the thermostat temperature rating. When the fluid temperature in an engine coolant system rises to the temperature rating of the thermostat 37, circulation continues and a user could verify that circulation is continuing by seeing the fluid level drop in the funnel 69 and expansion tank 47. Additionally the fluid level will rise in a waste receptacle 38 and forward flushing can be continued until the flushing fluid comes out in a preferred condition. By periodically replenishing a selected flushing fluid directly into an expansion tank 47, a complete flush could be attained. A common forward flush method with a coolant system with an expansion tank 47 is accomplished by disconnecting an upper radiator hose 35 from a radiator pipe 43, plugging the radiator pipe 43 with a rag or duct tape and warming up an engine 42. When the thermostat 37 opens, the discharge flows from the end of the upper radiator hose 35, pouring down through the engine compartment and into a catch tray, while replenishing fluid through an expansion tank 47. This method is not efficient for multiple reasons. In addition to not adequately controlling the discharge flow which is a hazardous material, the temperature of the fluid that is exiting an upper radiator hose 35 could be 195 degrees Fahrenheit or above and the possibility of fluid spilling onto engine components such as fans, belts, alternators and other engine components and the possibility of spilling discharged waste onto a repair shop floor or ground is increased. By replenishing the fluid through only an expansion tank 47, the fluid flow could be encumbered, leading to an inadequate amount of fluid being made available to the water pump. Additionally, by replenishing the fluid through only an expansion tank 47, the radiator 58 might not be adequately flushed and fluid flow could be encumbered, leading to an inadequate amount of fluid being made available to the water pump. The result could be an engine water pump cavitating. A second result of an inadequate fluid flow could cause the fluid to boil inside the engine 42, creating steam. A thermostat 37 might not open properly if air is trapped next to it which could interrupt the steady flow of fluid throughout the coolant system. This phenomenon is sometimes called "tea kettling". Replenishing a radiator 58 through a radiator pipe 43 and an expansion tank 47 the fluid could be less encumbered resulting in a steady fluid flow. By maintaining an adequate supply of fluid in the funnel 69, the fluid supply assembly 100 and an expansion tank 47, the chances of a water pump cavitation, engine fluid boiling, and air trapped next to the thermostat could be minimized. By utilizing this flushing method it is possible to observe the strength of an engine water pump and ascertain whether it is functioning properly. Additionally, by utilizing this flushing method it is possible to observe whether the thermostat is functioning properly.

Figure 9:
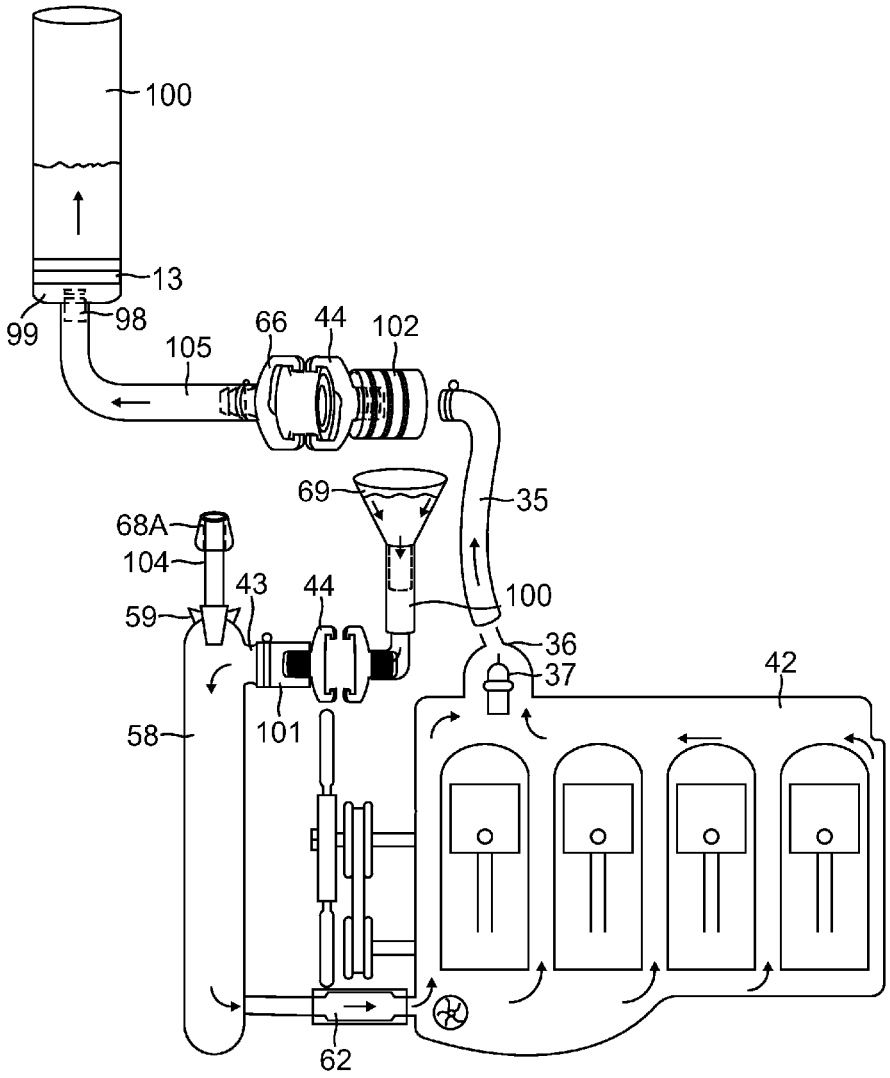
FIG. 9 illustrates an example of a forward flush method and system with a discharge/diagnostic hose assembly connected to a radiator hose using a coolant system without an expansion tank.

FIG. 9 illustrates a funnel 69, a fluid supply assembly 100 a pipe adaptor assembly 101, a radiator pipe 43, a radiator neck 59, a sight tube assembly 104, a radiator 58, a lower radiator hose 62, an engine 42, a thermostat 37, a radiator hose connection 36, an upper radiator hose 35, a hose adaptor assembly 102, a discharge/diagnostic hose assembly 105 and a waste receptacle 38. Directional arrows indicate the path of fluid flow. This is an example of a forward flush method with a coolant system that has a radiator 58 with a radiator neck 59.

In this embodiment a clear visual tube 100 could be raised above the radiator pipe 43 during the flushing process to diagnose a water pumps strength & the circulation flow in the coolant system. With an engine idling, a properly functioning water pump will cause the fluid to circulate into a radiator pipe 43. A water pump that can not create enough pressure to push fluid up to the radiator pipe 43, indicates a defective water pump or poor circulation. With a weak or malfunctioning water pump, the pressure created buy the water pump could be inadequate, thus indicated by the fluid rise in the visual tube 100. Additionally a steady rise in the visual tube 100 would indicate that the coolant system has proper circulation. One example would be, if a person with a bad cut on a hand and if that person raised their hand above the heart, blood would stop flowing, lower the hand blood starts flowing again.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. An apparatus to forward flush dirty coolant from a liquid cooled engine including a discharge hose assembly including a length of flexible hose, a hose clamp adjacent a first end with a barbed connector retained at the first end, the apparatus to forward flush coolant comprising:

a. a fluid supply assembly including a tube connected at one end to a 90 degree fitting, which 90 degree fitting is retained at a first end to the tube by a hose clamp, the 90 degree fitting receiving a quick release connector connected at a second end of the 90 degree fitting;

b. a pipe adapter assembly including a threaded, quick release connector threaded into a threaded adapter located within an adjacent one end of a radiator hose, a clamp affixed on an exterior surface of the radiator hose;

c. a hose adapter assembly including a threaded quick release connector threaded into one end of a rigid cylindrical shaped adaptor which has a multiplicity of spaced apart grooves on its cylindrical surface;

d. a sight tube assembly including a transparent tube with a first frustum shaped cone surrounding the transparent tube for a given distance adjacent a first end of the transparent tube and a second frustum shaped cone surrounding the transparent tube for a given distance adjacent a second end of the frustum shaped tube;

e. a discharge/diagnostic hose assembly including a length of flexible hose, a barbed connector received in a first end of the length of a flexible hose and retained by a first hose clamp, and a clear diagnostic tube retained adjacent a second end of the length of a flexible hose by a threaded hose barb and a threaded cylindrical insert with the length of flexible hose and retained by a second hose clamp;

f. a funnel inserted into the fluid supply assembly, the quick release connector of the fluid supply assembly connected to the threaded quick release connector of the hose adaptor assembly and connected at its opposite end to an upper radiator hose which in turn is connected to a radiator by a radiator pipe, the radiator connected by fluid tubes to an expansion tank with the sight tube assembly retained in the expansion tank with the transparent tube and one frustum shaped cone visible;

g. a radiator hose connecting the expansion tank to an engine; and h. the engine connected to a thermostat which in turn is connected to a radiator hose connection connected to the pipe adaptor assembly with its threaded quick release connector to the barbed connector of the discharged hose assembly with its length of flexible hose extending from the barbed connector to a waste receptacle;

i. when the discharge hose assembly is opened and the engine is turned on, the fluid in the engine is heated until the heated fluid temperature causes the thermostat to open at a designated temperature so that the engine water pump circulates the heated fluid through the engine coolant system until the heated fluid becomes dirty heated fluid and the engine water pump pulls the dirty heated fluid into the lower radiator hose from the radiator and the expansion tank and out of the discharge hose into a waste receptacle after the dirty heated fluid has been removed and replenishes the dirty heated fluid with clean coolant fluid which is poured into the funnel to replenish the coolant system with clean coolant fluid.

2. An apparatus to forward flush dirty coolant from a liquid cooled engine, comprising a. a fluid supply assembly including a tube connected at one end to a 90 degree fitting, which 90 degrees fitting is retained at a first end to the tube by a hose clamp, the 90 degree fitting receiving a connector at a second end of the 90 degree fitting;

b. a pipe adapter assembly including a connector retained in an adapter located within an adjacent one end of a radiator hose;

c. a hose adapter assembly including a connector retained into one end of a cylindrical shaped adapter;

d. a discharge/diagnostic hose assembly including a length of flexible hose, a connector in a first end of the length of a flexible hose and retained in the diagnostic discharge hose, a clear diagnostic tube retained adjacent a second length of a flexible hose by a hose barb and a cylindrical insert with the second length of hose retained by a retaining member;

e. a water/coolant insertion member inserted into a fluid supply assembly, the connector of the fluid supply assembly connected to a connector of the hose adaptor and connected at its opposite end to an upper radiator hose which in turn is connected to a radiator by a radiator pipe, the radiator connected by fluid tubes to an expansion tank, a member to create a transparent member selected from the group consisting of the expansion made of transparent material and a sight tube assembly inserted into the expansion tank, the tube assembly including a transparent tube visible from the expansion tank;

f. a radiator hose connecting the expansion tank to an engine containing fluid and a water pump; and g. the engine connected to a thermostat which in turn is connected to a radiator hose connection connected to the pipe adaptor assembly with its connector connected to a connector of a discharge/diagnostic hose assembly with a length of flexible hose extending from the discharge hose connector to a waste receptacle;

h. when the discharge/diagnostic hose assembly is opened and the engine is turned on, the fluid in the engine is heated until the heated fluid temperature causes the thermostat to open at a designated temperature so that the engine water pump circulates the dirty heated fluid through the engine coolant system and pulls the dirty heated fluid into the lower radiator hose from the radiator and the expansion tank including the dirty heated fluid inside the engine and out of the discharge hose into a waste receptacle after the dirty heated fluid has been removed and replenishes the dirty heated fluid with clean coolant which is poured into the water/coolant insertion member to replenish the coolant system with clean coolant until the coolant system is filled with clean coolant and then the discharge hose is closed.

3. An apparatus to forward flush dirty coolant from a liquid cooled engine including a discharge hose assembly including a length of flexible hose, a hose clamp adjacent a first end with a barbed connector retained at the first end, the apparatus to forward flush coolant comprising:

a. a fluid supply assembly including a tube connected at one end to a 90 degree fitting, which 90 degree fitting is retained at a first end to the tube by a hose clamp, the 90 degree fitting receiving a quick release connector at a second end of the 90 degree fitting;

b. a hose adaptor assembly including a threaded, quick release connector threaded into one end of a ridged cylindrical shaped adaptor which has a multiplicity of spaced apart grooves on its cylindrical surface located within an adjacent end of a radiator hose, a clamp affixed on an exterior surface of the radiator hose;

c. a sight tube assembly including a transparent tube with a first frustum shaped cone surrounding the transparent tube for a given distance adjacent a first end of the transparent tube and a second frustum shaped cone surrounding the transparent tube for a given distance adjacent a second end of the frustum shaped tube;

d. a pipe adaptor assembly including a threaded, quick release connector threaded into a threaded adaptor, a funnel inserted into the fluid supply assembly connected to the quick release connector of the pipe adaptor and connected to a radiator pipe with a sight tube assembly retained in a radiator neck with the transparent tube and frustum shaped cone of the sight tube assembly visible;

e. a discharge hose assembly including a length of flexible hose, a barbed connector received in a first end of the length of a flexible hose and retained by a first hose clamp; and f. an engine connected to a thermostat housing which in turn is connected to a radiator hose connected to a hose adaptor assembly retained by an exterior hose clamp having a threaded quick release connector which is in turn connected to the barbed connector of the discharge hose assembly with a length of flexible hose extending from the barbed connector to a waste receptacle;

i. when the discharge hose assembly is opened and the engine is turned on, the fluid temperature in the engine is heated until the heated fluid temperature causes the thermostat to open at a designated temperature so that the engine water pump circulates the heated fluid through the engine coolant system and pulls dirty heated fluid into the lower radiator hose from the radiator and out of the discharge hose into a waste receptacle after the dirty heated fluid has been removed and replenishes the dirty heated fluid with clean coolant which is poured into the funnel so clean coolant is replenished directly into the radiator pipe until the coolant system is filled with clean coolant.

* * * * *